US008067905B2

(12) United States Patent
Jalbout et al.

(10) Patent No.: US 8,067,905 B2
(45) Date of Patent: Nov. 29, 2011

(54) POWER LINE PRECONDITIONER FOR IMPROVED LED INTENSITY CONTROL

(75) Inventors: Bassam D. Jalbout, Mont-Royal (CA); Brian Wong, Kirkland (CA)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 12/625,118

(22) Filed: Nov. 24, 2009

(65) Prior Publication Data

US 2010/0072907 A1 Mar. 25, 2010

Related U.S. Application Data

(63) Continuation of application No. 11/882,322, filed on Jul. 31, 2007, now Pat. No. 7,638,950.

(51) Int. Cl.
*H05B 41/36* (2006.01)

(52) U.S. Cl. ..... 315/308; 315/291; 315/224

(58) Field of Classification Search ..... 315/291, 315/307, 308, 209 R, 119, 121, 122, 123, 315/125–128, 185 R, 186, 192, 193, 185 S, 315/210, 224–226, 294, 297, 299–302, 310–311, 315/362

See application file for complete search history.

(56) References Cited

U.S. PATENT DOCUMENTS

| | | | | |
|---|---|---|---|---|
| 4,001,667 | A | 1/1977 | Bober | |
| 5,034,757 | A | 7/1991 | Godlove | |
| 5,164,329 | A | 11/1992 | Moyer et al. | |
| 5,166,702 | A | 11/1992 | Mattern et al. | |
| 5,444,531 | A | 8/1995 | Foreman et al. | |
| 5,701,133 | A | 12/1997 | Miller et al. | |
| 5,859,592 | A | 1/1999 | Carlin | |
| 6,160,354 | A | 12/2000 | Ruvinskiy | |
| 6,262,440 | B1 | 7/2001 | Haberern et al. | |
| 6,489,728 | B2 | 12/2002 | Guthrie et al. | |
| 6,529,182 | B1 | 3/2003 | Burton | |
| 6,600,274 | B1 | 7/2003 | Hughes | |
| 6,614,056 | B1 | 9/2003 | Tarsa et al. | |
| 6,621,235 | B2 | 9/2003 | Chang | |
| 6,627,863 | B2 * | 9/2003 | Wasserman | 250/205 |
| 6,795,321 | B2 | 9/2004 | Balakrishnan et al. | |
| 6,798,152 | B2 * | 9/2004 | Rooke et al. | 315/209 R |
| 6,885,036 | B2 | 4/2005 | Tarsa et al. | |
| 7,005,914 | B2 | 2/2006 | Balakrishnan et al. | |
| 7,038,594 | B2 | 5/2006 | Voreis et al. | |
| 7,119,498 | B2 | 10/2006 | Baldwin et al. | |
| 7,190,215 | B2 | 3/2007 | Balakrishnan et al. | |

* cited by examiner

*Primary Examiner* — Douglas W Owens
*Assistant Examiner* — Jianzi Chen
(74) *Attorney, Agent, or Firm* — McDermott Will & Emery LLP

(57) ABSTRACT

A switched preconditioner circuit is provided at the power input end of a light source to effectively drop the voltage of the light source to zero volts whenever the light source is required to be in an OFF state thereby eliminating the problem of unwanted current through the light source. The preconditioner circuit may include a terminal connected to a first power potential, a terminal connected to a power node at the power input end of the light source, and an input to receive a preconditioner control signal to place the preconditioner circuit in one of an ON state and an OFF state. The preconditioner circuit supplies the voltage to the power node in its ON state and effectively eliminates the voltage to the power node in its OFF state. The preconditioner circuit also may include a bleed path connected between the power node and a second or ground potential to shunt all power supplied to the power node when the preconditioner circuit input receives a signal to place the preconditioner circuit in the OFF state.

19 Claims, 4 Drawing Sheets

POWER LINE PRECONDITIONER FOR IMPROVED LED INTENSITY CONTROL

TECHNICAL FIELD

The following description relates generally to control of light intensity, and in particular to light intensity control using pulses of fixed duration and frequency.

BACKGROUND

The control of the intensity of light emitting diodes (LEDs) in an LED display screen is crucial to overall performance of the screen. For example, screen contrast is the ratio between the brightest possible output of the display LEDs divided by the minimum brightness. In order to maximize the contrast ratio and provide the best black and/or deep colors, it is important to minimize and/or substantially eliminate the electrical current that flows through the LEDs when an LED array should be in the OFF state. However, typical LED display screens often have some current flow through the LEDs in the OFF state thereby decreasing overall contrast of the screen. In addition, due to the high density of electronics in a large display board and the relatively high current levels using in switching all the LEDs in such a display, pick up noise may be present in the control lines of the power switches. The undesired noise results in unwanted current flow through the LEDs and also decreases contrast.

SUMMARY

In one general aspect, the use of a switched preconditioner at the power input end of a light source effectively drops the voltage of the source to zero volts whenever the light source is required to be in the OFF state thereby eliminating the problem of unwanted current through the LED arrays.

In one general aspect a system includes a first power potential supplying a voltage; a second power potential; a light source have a power supply side and a power return side; a power node connected to the power supply side of the light source; a current switch connected between the power return side of the light source and the second potential, the current switch including an input to receive a current switch control signal to place the switch in one of an ON state and an OFF state allowing current to flow through the current switch in the ON state; and a preconditioner circuit connected to the first power potential and the power node, the preconditioner circuit including an input to receive a preconditioner control signal to place the preconditioner circuit in one of an ON state and an OFF state, wherein the preconditioner circuit supplies the voltage to the power node in its ON state and effectively eliminates the voltage to the power node in its OFF state.

The precondition circuit may include a preconditioner connected between the first potential and the power node and a bleed path connected between the power node and the second potential. In one example, the preconditioner is a field effect transistor having a gate to receive the preconditioner control signal. In another example, the bleed path has a first impedance and the current switch has a second impendence in the OFF state that is greater than the first impedance.

The preconditioner control signal includes a pulse having a longer duration than a corresponding pulse of the current control single and is timed to pulse high before the current control signal pulses high and is timed to pulse low after the current control signal pulses low.

The system may further include a processing device to generate the current switch control signal and the preconditioner control signal.

The light source may be a light emitting diode or an array of light emitting diodes. The light source also may be a light emitting diode of a display device.

In another general aspect, a preconditioner circuit for use in a lighting circuit includes a first power potential supplying a voltage, a second power potential, a light source have a power supply side and a power return side, a power node connected to the power supply side of the light source, and a current switch connected between the power return side of the light source and the second potential, the current switch including an input to receive a current switch control signal to place the switch in one of an ON state and an OFF state allowing current to flow through the current switch in the ON state, and the precondition device includes: a terminal connected to the first power potential; a terminal connected to the power node, and an input to receive a preconditioner control signal to place the preconditioner circuit in one of an ON state and an OFF state, wherein the preconditioner circuit supplies the voltage to the power node in its ON state and effectively eliminates the voltage to the power node in its OFF state.

The preconditioner may further include a bleed path connected between the power node and the second potential to shunt all power supplied to the power node when the precondition circuit input receives a signal to place the preconditioner circuit in the OFF state. The bleed path may have a first impedance that is less than an impedance of the current switch when the current switch is in the OFF state.

The wherein the preconditioner control signal includes a pulse having a longer duration than a corresponding pulse of the current control single and is timed to pulse high before the current control signal pulses high and is timed to pulse low after the current control signal pulses low.

The precondition control signal may be received from a processing device.

Other features will be apparent from the description, the drawings, and the claims.

DESCRIPTION OF DRAWINGS

Like reference symbols in the various drawings indicate like elements.

DETAILED DESCRIPTION

The following description provides a circuit for improved performance and control of a light source, such as, for example, a light emitting diode (LED) and LED arrays. As described below, residual quiescent current and pick up noise current are eliminated and/or substantially reduced when the light source is in the OFF state. Conventional control of the electronic current through a light source is susceptible to both a leakage current and noise generated currents when the light source should be in the OFF state (with zero current flowing through the light source). According to the following description, a preconditioner circuit substantially eliminates and/or greatly reduces the influence of these undesired currents. The preconditioner circuit may be used with an light source; however, it is particularly applicable to LED video display screens and general LED illumination to improve the performance of the LED(s) when placed in the OFF state.

Figure 1:
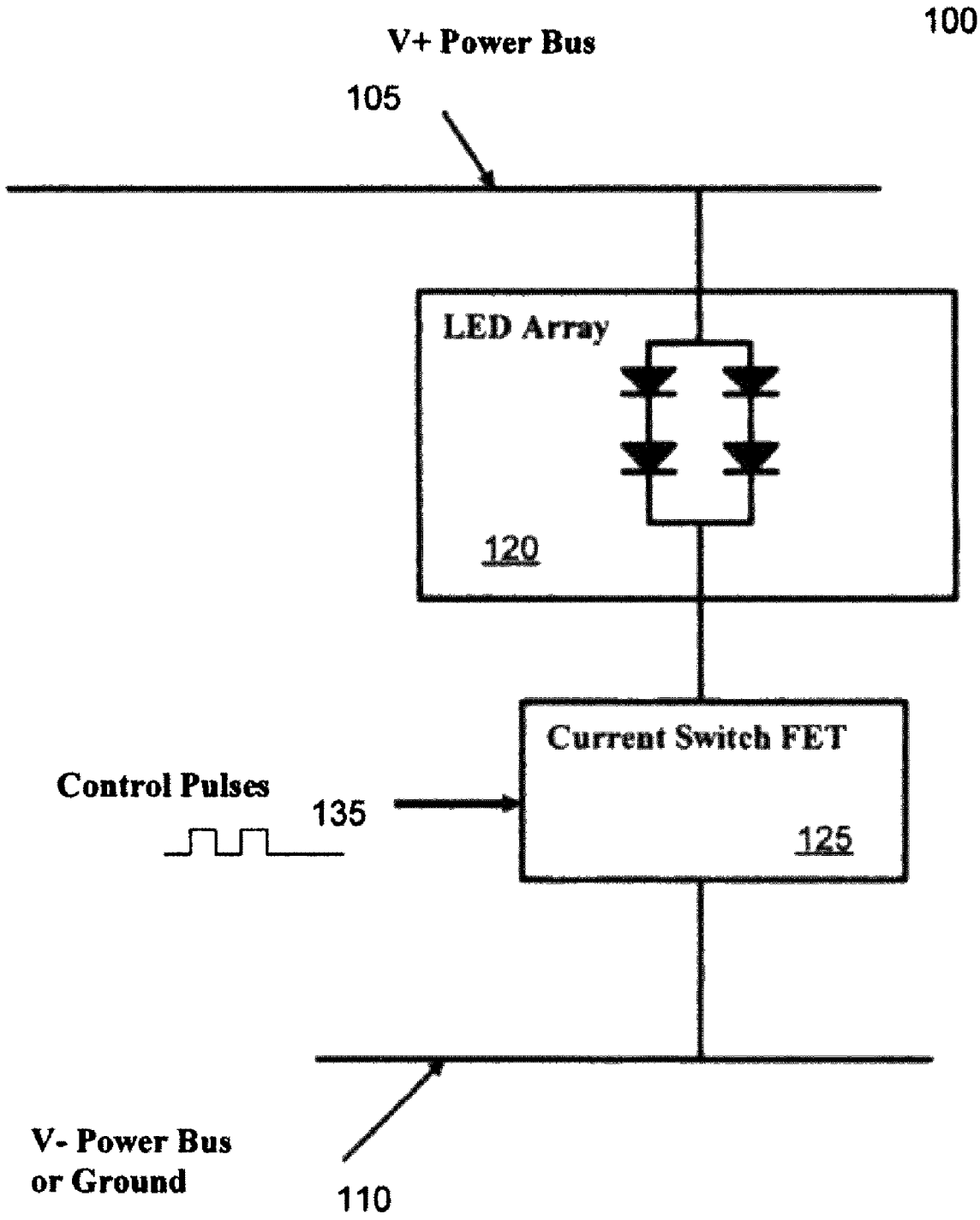
FIG. 1 is an exemplary block diagram for a circuit for intensity control of a light source.

FIG. 1 shows one example of a light system 100 that may be used to illustrate controlling the intensity emitted by a light source, such as, for example, LEDs. The system 100 may include a first power potential 105, a second power potential 110, a light source 120, and a current switch 125. The first potential 105 may be implemented as a power bus or a positive voltage side. The second potential 110 may be a power return, a sink, or a ground. Although FIG. 1 shows the use of a positive power rail, it will be appreciated that a negative power rail also may be used.

The light source 120 may be implemented by any configuration of LEDs to provide illumination or a display. In the example shown in FIG. 1, the light source 129 is implemented using an array of four LEDs arranged in a 2×2 matrix. Although FIG. 1 shows four LEDs in a 2×2 matrix, one skilled in the art will appreciate that other configurations are possible, including a single LED, multiple LEDS, or matrixes of any number of LEDs (e.g., as a particular application requires). The array of LEDs may form a pixel of the display screen. As shown, the power supply is connected directly to the anode end of the LED array through the first potential 105, and the cathode end of the LED array is connected directly to the current switch 125.

The light source 120 is connected to the second potential by the current switch 125. The current switch 125 determines when the electrical current flows through the light source 120 or in this case the LED array. The current switch 125 includes an input 135 for a current control signal that may be used to trigger an ON or an OFF state of the current switch 125. When the control signal 135 triggers an ON state, current flows from the light source 120 to the second potential 110. The current control signal may be generated by a processing device (not shown). The processing device may be implemented using, for example, a processor, an ASIC, a digital signal processor, a microcomputer, a central processing unit, a programmable logic/gate array to generate, among other things, the current control signal. The processing device also may include associated memory. The processing device may implement a digital counter to generate pulses of a particular duration and timing on inputs 135 to control the intensity of the light emitted by the source 120.

By providing a return path for the electrical connection of the LED array to ground, current flows through the array, and the LEDs light while in the ON state. If there is no connection or return path, then no current should flow, and the LED(s) should be in the OFF state. The current switch 125 provides or breaks the connection to allow flow of current by placing or removing a high impedance on the return path. It is noted that, if the ON state were continuously maintained, the maximum possible current would flow through the LED(s). As a result, the LED array would heat to the point of destroying the circuit 100. Therefore, the current switch 125 is placed in the ON state only for short periods of time followed by the OFF state to allow for cooling. The maximum average current that may be supplied to the LED array is set by the LED manufacturer's specification.

The average current supplied to the LEDs is controlled by providing current control pulses to place the current switch 125 in a corresponding ON or OFF state. Several approaches can be used to provide control pulses, such as, for example, Pulse Width Modulation (PWM), frequency modulation, and Fixed Frequency/Fixed Duration FF/FD. PWM, also referred to as a pulsed duty cycle, generally requires that the width or duration of a pulse is varied in length to control the current supplied to a light source. Typically, the longer the pulse duration, the longer the current flows through the light source, the greater the average current flows through the circuit, and the brighter the LED light radiation or intensity is. Frequency control varies the frequency of the control pulses. A higher frequency provides more pulses, a greater average current, and a brighter intensity. The FF/FD control process provides a short burst of constant duration pulses at a fixed frequency. According to the FF/FD process, the higher number of pulses per burst means the greater the average current, and hence the brighter the LED. Further description of the FF/FD process is described in Applicant's concurrently filed and co-owned U.S. patent application Ser. No. 11/882,323 filed on Jul. 31, 2007 titled "Control of Light Intensity Using Pulses of a Fixed Duration and Frequency," now issued as U.S. Pat. No. 7,598,683, which is hereby incorporated by reference in its entirety for all purposes.

Although the current switch 125 provides a high impedance on the return path in the OFF state, it does not switch off completely when placed in the OFF state. For example, when the current switch 125 is placed in the OFF state by a low level of the current control pulse, some residual current leakage occurs through the current switch 125.

Figure 2:
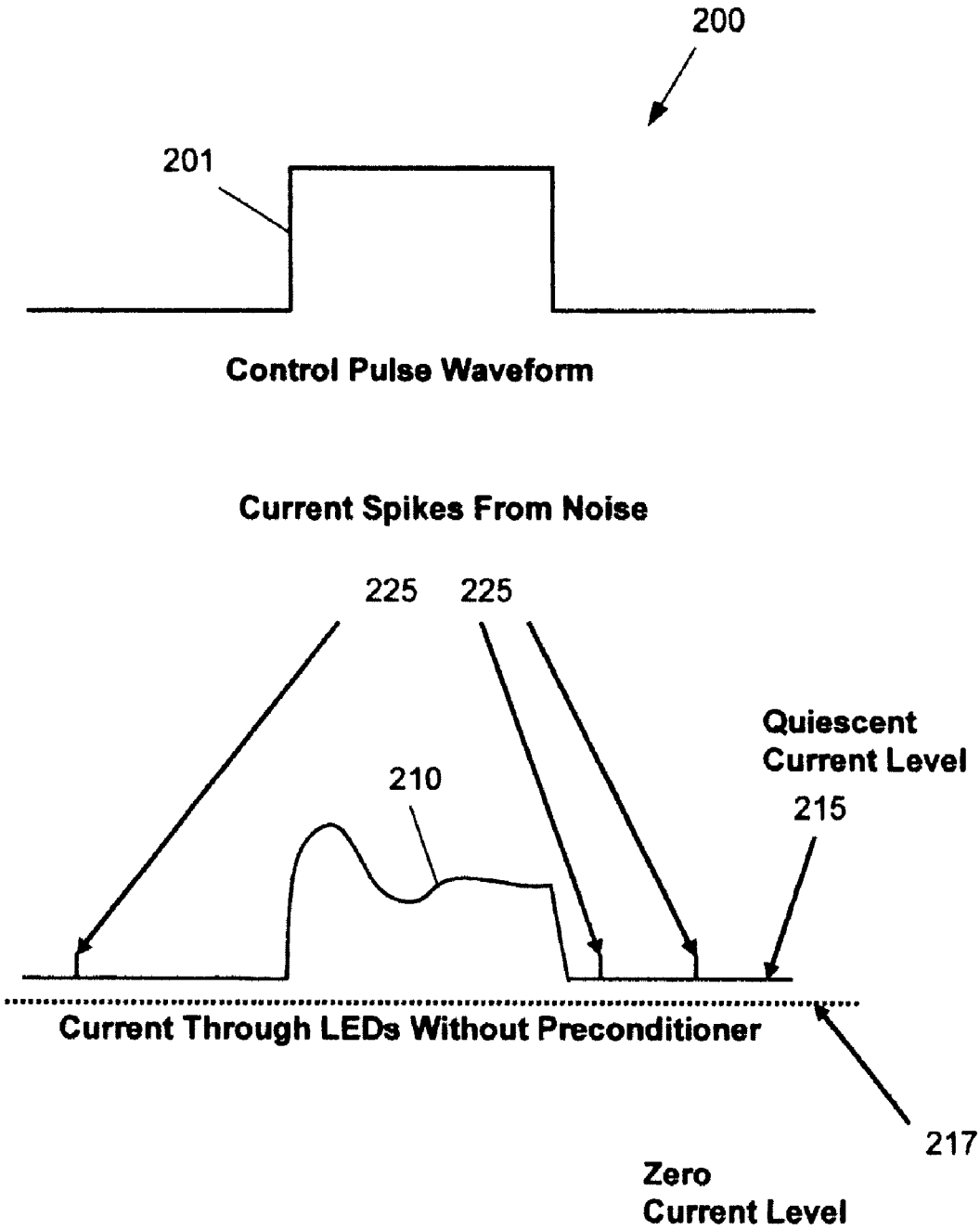
FIG. 2 shows an exemplary control pulse and corresponding current for the circuit of FIG. 1.

FIG. 2 shows a comparison 200 of an exemplary waveform of a control pulse and corresponding current waveform for the circuit of FIG. 1. The waveform 201 of a control pulse is an ideal waveform of a current control pulse that is provided to the input of the control switch 125. An ideal result of providing the control pulse would be a maximum of current flow through the light source 120 when the waveform is at high level, and zero current flow when the waveform is at a low level. However, because of inductive and capacitive effects of the power lines and the circuit elements, the actual current flowing through the LED array may be represented as the wave pattern 210.

As shown, when the current switch 125 is initially place in the ON state, there is a delay as the induction of the electronic path through the power lines, LED array, and current switch 125 causes a ramp up of current flow. In addition, the power line source 105 is initially unloaded and is at its highest value. As a result, there is an excess flow of current as the inherent capacitance of the circuitry discharges. The current flow then experiences some ringing before the current waveform settles to a constant level. When the waveform is in the high state, the maximum current does occur but with considerable ringing.

When the waveform is in the low state, a zero flow of current is desired. However, the current switch 125 allows some current to leak even when the switch 125 is placed in the OFF state. The quiescent current 215 is higher than the desired ideal zero current level 217. Since the maximum contrast ratio of an LED screen is greatly dependant on the ratio of the maximum current divided by the minimum current, any decrease in the minimum current during the OFF state provides a better maximum contrast ratio.

The circuit of FIG. 1 also is susceptible to switching noise. In applications, such as a large video display screen, many pixels and many LEDs are being switched between the ON and OFF states by current control pulses. As a result, there is considerable pickup noise or crosstalk on the high impedance input 135 used to input the current control pulses to the current switch 125. The noise causes the current switch 125 to momentarily allow a spike in current 225 as undesired current noise. Again such spikes decrease the overall maximum contrast ratio.

Figure 3:
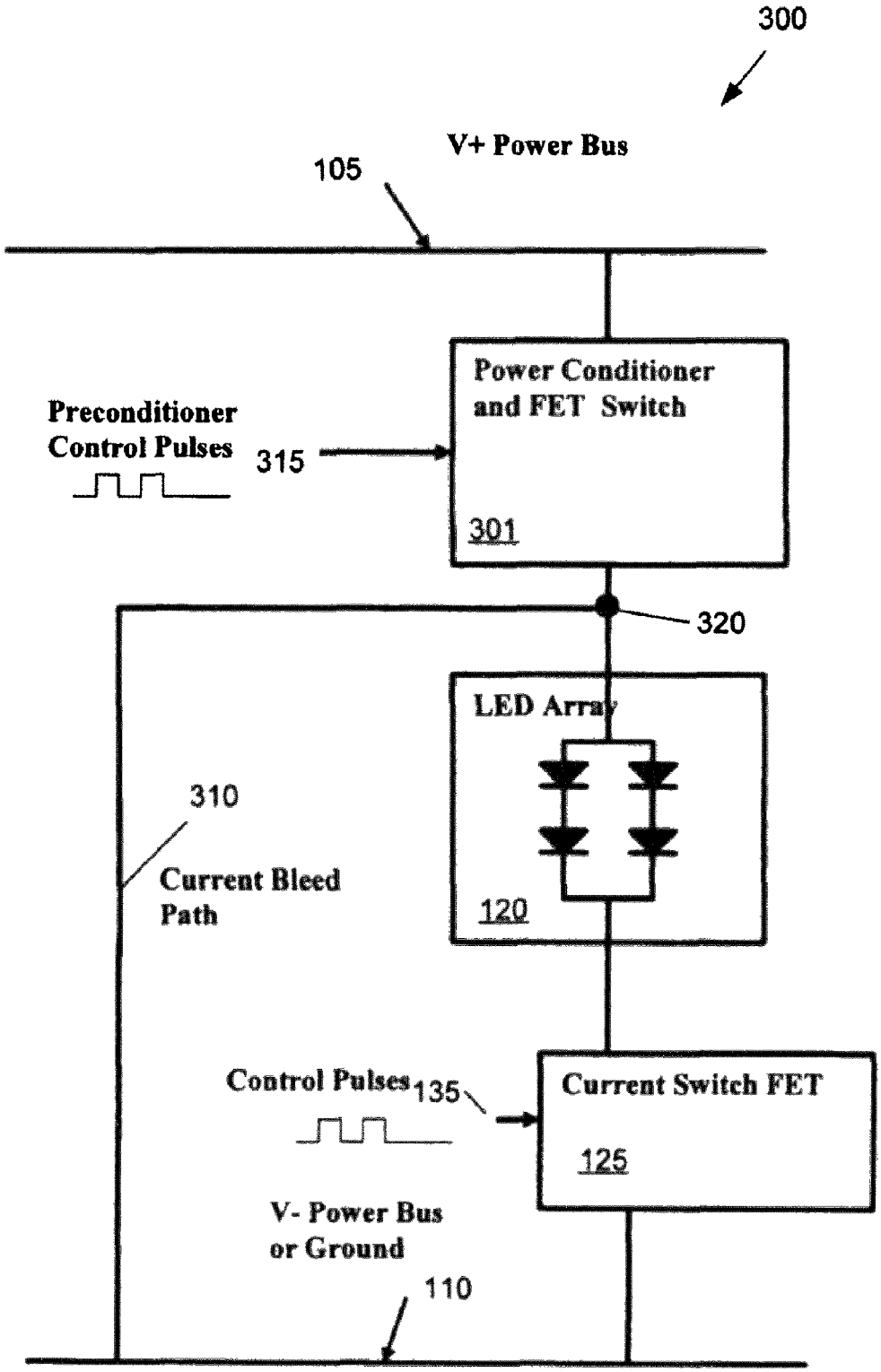
FIG. 3 is an exemplary block diagram for a circuit with preconditioner for intensity control of a light source.

FIG. 3 shows an exemplary block diagram of a circuit 300 that is similar to the circuit 100; however, the circuit 300 includes a preconditioner circuit. The preconditioner circuit includes a preconditioner 301 and a bleed path 310. The preconditioner 301 is placed between the first potential 105 and the light source 120. The preconditioner 301 stabilizes fluctuations on the power bus and may include an input 315. In one example, the preconditioner 301 may be implemented using a switch, for example, a transistor, such as a field effect transistor (FET). The preconditioner 301 may be switched between an ON and an OFF state, for example, by applying a control signal of pulses to input 315 to address a particular light source or set of light sources that are switched on simultaneously. The control signal may be supplied by a processing device, such as the processing device described above to generate the current control signal for the current control switch 125.

The preconditioner circuit also includes the bleed path 310 providing an electrical connection from a node 320 (e.g., between the preconditioner 301 and the anode side of the LED array). The bleed path 310 pulls the node 320 to zero volts (or ground) whenever the preconditioner 310 is placed in the OFF state. The bleed path 310 may include a high value resistor or a slightly reactive circuit to maximize settling time between the start of the preconditioner control pulse to the high level state (i.e., preconditioner ON state) and the start of the current control pulse to the high level (current switch ON state). The resistance of the bleed path 310 should be less than the resistance of the current switch 125 in its OFF state to allow the path to bring node 320 to nearly zero volts when the preconditioner is in the OFF state.

The preconditioner 301 isolates the power bus or first potential 105 from the light source 120. By isolating the power bus 105 from the light source 120, the input voltage to the LED array of the light source 120 may be switched from full V+ voltage to nearly zero volts. When the preconditioner 301 is set to the OFF state by a low level of the preconditioner control pulse to input 315, the light source 120 is isolated from the first potential 105, and any current that leaks through the preconditioner 301 is shunted to ground by the current bleed path 310. As a result, when the preconditioner control pulse input to the preconditioner 301 is at a low level, the voltage at node 320 becomes nearly zero volts. Therefore, the current flow through light source 120 is substantially zero during the OFF state of the current switch 125 thereby eliminating the quiescent current level and any current spikes due to noise on input 135.

Conversely, when the preconditioner control pulse is at high level, the preconditioner 301 conducts current and the node 320 rises to V+ volts of the first potential 105. Once node 320 is placed at the high potential and the current switch 125 is place in the ON state, maximum current flow is provided to the LED array of light source 120 (as the impedance through the current switch 125 is substantially less than the impedance of the bleed path.

Figure 4:
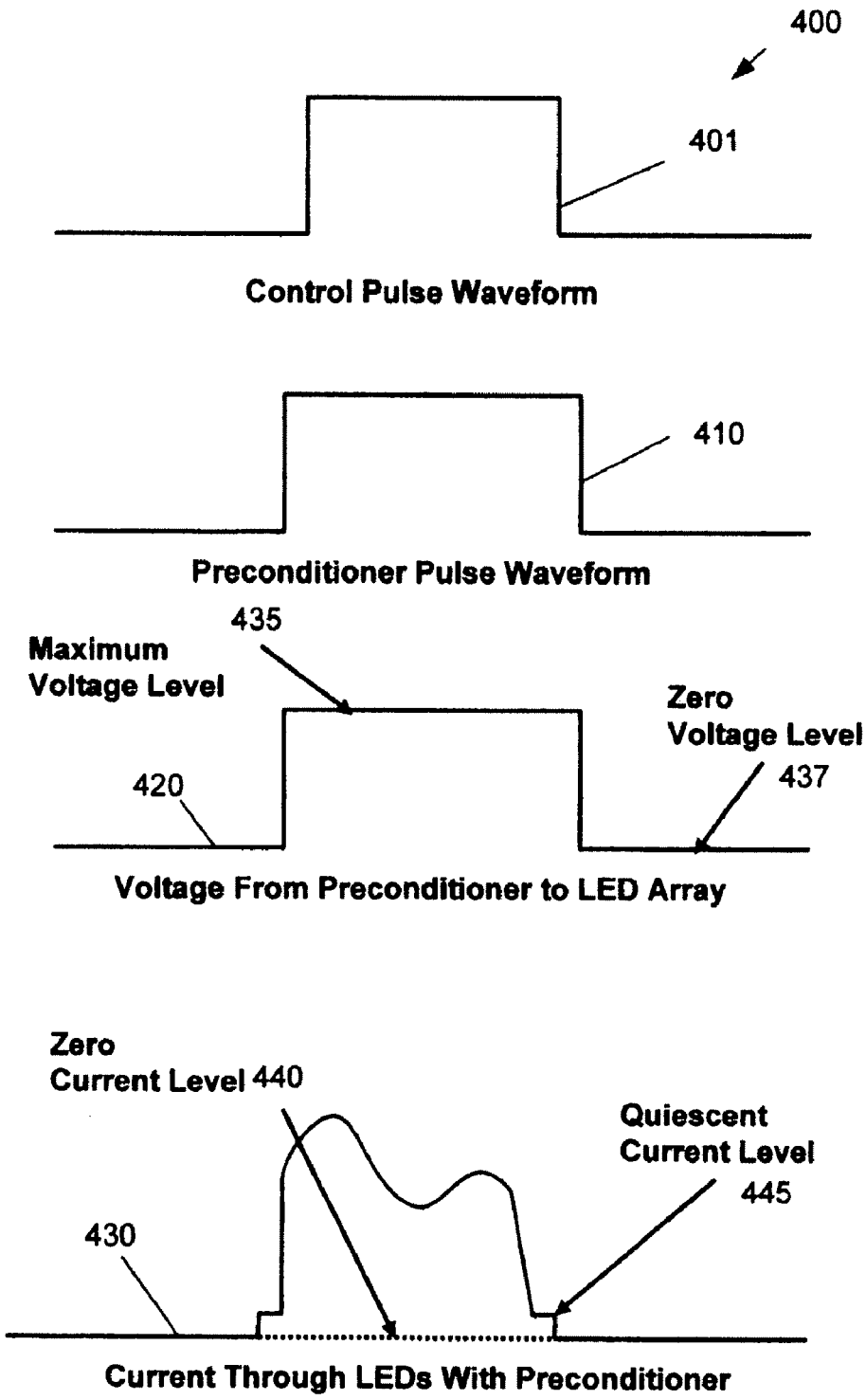
FIG. 4 shows an exemplary control pulses and corresponding voltage levels and current for the circuit of FIG. 3.

FIG. 4 shows an exemplary comparison 400 of a control pulse waveform 401 to the power switch 125, a preconditioner control pulse waveform 410 to the preconditioner 301, a voltage signal level waveform 420 at the anode of the LED array, and the corresponding current waveform 430 for the circuit of FIG. 3. A control pulse waveform 401 to the power switch 125 pulses to a high level for a predetermined time to place the current switch 125 in the ON state. As can be seen, the preconditioner control pulse waveform 410 to the preconditioner 301 has a slightly longer duration than the current control pulse and is timed to pulse high before the current control signal pulses high and is time to pulse low after the current control signal pulses low. The waveform 420 shows the maximum voltage level 435 and the minimum voltage level 437 at the connection between the preconditioner and the LED anodes. The waveform 430 shows the resultant current flow through the LED array. The zero current level 440 and the quiescent current level 445 are shown.

By comparing FIG. 2 and FIG. 4, the difference between the current control with and without the preconditioner circuit are evident. As discussed earlier, FIG. 2 shows how the continual presence of the voltage V+ at the anodes of the LED array leads to a leakage current and susceptibility to noise. As seen in FIG. 4, the control pulses to the current switch 125 are similar to those shown in FIG. 2; however, as shown in FIG. 4, the second set of preconditioner control pulses reduces the overall minimum current level.

The control signal waveform 410 used to control the preconditioner 301 is longer in duration and encapsulates the current control waveform 401. As a result, the V+ voltage is applied to the LED array with the voltage waveform 420. Since the preconditioner waveform 420 is longer in duration and encapsulates both ends of the current control pulse (i.e. both the rising and falling edges of the current control pulse), the preconditioner waveform 420 does not interfere with the maximum current flow state of the current switch 125. By beginning slightly before the leading edge (e.g., on the order of a few nanoseconds), o the preconditioner 301 ensures that the V+ voltage stabilizes prior to the transition of the current switch 125 to the ON state. Similarly, by ending a bit later (e.g., on the order of a few nanoseconds) than the trailing edge of the current control pulse, the preconditioner 301 does not interfere with the timing of the current control pulse. The preconditioner waveform 420 does limit the quiescent current level 445 to a very short duration thereby minimizing the overall minimum current level. In addition, the current waveform 430 does not experience any current spikes 225.

As mentioned above, pulse control techniques used to switch the LEDs using timed pulses of ON time are interspersed with periods of OFF time. However, when an LED is switched into the OFF state, some quiescent current still flows due to leakage of the current switch. This undesired quiescent current increases with temperature. As a result, as heat builds up in the light source, such as a display, and the LEDs of the display experience an even higher level of quiescent current. In addition, due to the density of electronics in display boards, the control pulse lines may pick up noise from the switching of adjacent electronics, such as other LED arrays (i.e., other pixels) resulting in spurious pulses of unwanted current through the LEDs.

Inserting a preconditioner circuit between the first potential (e.g., the power supply or the voltage rail) and the power supply or anode side of the LED array provides power to the LED array only when a current flow is required. The preconditioner circuit effectively drops the power supply voltage to zero volts when the LED current is desired to be zero. As a result of providing a zero voltage on the power supply side, there is no leakage of current through the power switch when in the switch is placed in off condition. In addition, any current flow previously associated with noise of adjacent circuits during the OFF periods of the switch is effectively eliminated. Therefore, the description provided herein, drastically reduces the leakage or quiescent current and prevents pickup noise on the current control line providing a higher maximum contrast ratio. The preconditioner circuit also ensures that the initial starting conditions are identical for each control pulse. This results in nearly full linear accuracy for control of the intensity of the light source using the FD/FF control process.

A number of exemplary implementations and examples have been described. Nevertheless, it will be understood that various modifications may be made. For example, suitable results may be achieved if the operations of described techniques are performed in a different order and/or if components in a described system, architecture, device, or circuit are combined in a different manner and/or replaced or supplemented by other components. Accordingly, the above described examples and implementations are illustrative and other implementations not described are within the scope of the following claims.

What is claimed is:

1. A system comprising:

a first power potential configured to supply a voltage;

a second power potential;

a power supply circuit configured for connection to a light source and including a power supply side and a power return side;

a power node connected to the power supply side;

a current switch connected between the power return side and the second potential, the current switch including an input configured to receive a current switch control signal to place the switch in one of an ON state and an OFF state allowing current to flow through the current switch in the ON state;

a preconditioner circuit connected to the first power potential and the power node, the preconditioner circuit including an input configured to receive a preconditioner control signal to place the preconditioner circuit in one of an ON state and an OFF state, wherein the preconditioner circuit is configured to supply voltage to the power node in its ON state and effectively eliminate the voltage to the power node in its OFF state; and a bleed path between the power node and the second potential and configured to shunt all power supplied to the power node when the preconditioner circuit input receives a signal to place the preconditioner circuit in the OFF state.

2. The system of claim 1 wherein the preconditioner circuit includes a preconditioner connected between the first potential and the power node.

3. The system of claim 2 wherein the preconditioner is a field effect transistor having a gate to receive the preconditioner control signal.

4. The system of claim 2 wherein the bleed path has a first impedance and the current switch has a second impendence in the OFF state that is greater than the first impedance.

5. The system of claim 1 wherein the preconditioner control signal includes a pulse having a longer duration than a corresponding pulse of the current control single and is timed to pulse high before the current control signal pulses high and is timed to pulse low after the current control signal pulses low.

6. The system of claim 1 further comprising a processing device to generate the current switch control signal and the preconditioner control signal.

7. The system of claim 6, wherein the processing device is a software-programmed processor, a firmware-programmed processor, or a programmable logic device (PLD).

8. The system of claim 7, wherein the programmable logic device (PLD) comprises a programmable array logic (PAL) device.

9. The system of claim 7, wherein the programmable logic device (PLD) comprises a programmable logic array (PLA) device.

10. The system of claim 1 wherein the light source is a light emitting diode.

11. The system of claim 1 wherein the light source is an array of light emitting diodes.

12. The system of claim 1 wherein the light source is a light emitting diode of a display device.

13. A preconditioner circuit for use in a lighting circuit including a first power potential supplying a voltage, a second power potential, a light source have a power supply side and a power return side, a power node connected to the power supply side of the light source, and a current switch connected between the power return side of the light source and the second potential, the current switch including an input to receive a current switch control signal to place the switch in one of an ON state and an OFF state allowing current to flow through the current switch in the ON state, the preconditioner circuit comprising:

a terminal connected to the first power potential;

a terminal connected to the power node, an input configured to receive a preconditioner control signal and to place the preconditioner circuit in one of an ON state and an OFF state, wherein the preconditioner circuit is configured to supply voltage to the power node in its ON state and eliminate the voltage to the power node in its OFF state; and a bleed path between the power node and the second potential and configured to shunt all power supplied to the power node when the preconditioner circuit input receives a signal to place the preconditioner circuit in the OFF state.

14. The circuit of claim 13 wherein the bleed path has a first impedance that is less than an impedance of the current switch when the current switch is in the OFF state.

15. The circuit of claim 13 wherein the preconditioner control signal includes a pulse having a longer duration than a corresponding pulse of the current control single and is timed to pulse high before the current control signal pulses high and is timed to pulse low after the current control signal pulses low.

16. The circuit of claim 13 wherein the precondition control signal is received from a processing device.

17. The circuit of claim 16, wherein the processing device is a software-programmed processor, a firmware-programmed processor, or a programmable logic device (PLD).

18. The circuit of claim 17, wherein the programmable logic device (PLD) comprises a programmable array logic (PAL) device.

19. The circuit of claim 17, wherein the programmable logic device (PLD) comprises a programmable logic array (PLA) device.

* * * * *